United States Patent [19]

Lierke et al.

[11] Patent Number: 4,798,332

[45] Date of Patent: Jan. 17, 1989

[54] LIQUID ATOMIZER

[75] Inventors: Ernst-Günter Lierke, Schwalbach; Rudolf Grossbach, Camberg; Wolfgang Heide, Darmstadt; Karl Flögel, Todtnau; Martin Junger, Grafenberg, all of Fed. Rep. of Germany

[73] Assignee: Battelle-Institut E.V., Frankfurt am Main, Fed. Rep. of Germany

[21] Appl. No.: 191,773

[22] Filed: May 2, 1988

Related U.S. Application Data

[63] Continuation of Ser. No. 2,652, filed as PCT EP86/00307 on May 21, 1986, published as WO86/06985 on Dec. 4, 1986, abandoned.

[30] Foreign Application Priority Data

May 23, 1985 [DE] Fed. Rep. of Germany ..... 3518646

[51] Int. Cl.[4] ..... B05B 3/14

[52] U.S. Cl. ..... 239/102.2; 239/380; 310/323

[58] Field of Search ..... 239/102.2, 102.1, 380, 239/505; 310/321, 323

[56] References Cited

U.S. PATENT DOCUMENTS 4,412,505 11/1983 Haüler ..... 239/102.2
4,473,187 9/1984 Lierke et al. ..... 239/102.2

FOREIGN PATENT DOCUMENTS 3112340 4/1980 Fed. Rep. of Germany .
3108481 4/1980 Fed. Rep. of Germany .
2137083 2/1983 Fed. Rep. of Germany .

*Primary Examiner*—Andres Kashnikow
*Assistant Examiner*—Michael J. Forman
*Attorney, Agent, or Firm*—Fisher, Christen & Sabol

[57] ABSTRACT

The liquid atomizer consists essentially of an ultrasonic excitation system coupled with a narrow bending strip of so small thickness that it does not have sufficient inherent stability for linear alignment. In the case of excitation of bending waves with several essentially parallel, closely spaced nodal lines can be generated on the bending strip. Dimensional stability of the bending strip is achieved by at least one mechanical fixing devices and one prestressing device.

18 Claims, 2 Drawing Sheets

LIQUID ATOMIZER

This application is a continuation, of application Ser. No. 2,652, filed as PCT EP86/00307 on May 21, 1986, published as WO86/06985 on Dec. 4, 1986, now abandoned.

DESCRIPTION

The invention relates to a liquid atomiser with ultrasonic excitation system which is coupled with a narrow bending strip, on which bending waves with several essentially parallel closely spaced nodal lines can be generated by excitation.

In the case of conventional ultrasonic capillary-wave atomisers, atomisation is effected by separation of droplets from a standing capillary wave pattern with chessboard-like arrangement of nodal lines, which is formed at the liquid/gaseous phase boundary on a thin liquid film which is excited by a oscillating solid surface. Atomisation requires an excitation amplitude of the oscillating solid surface which is dependent on the frequency and on various liquid parameters, and an appropriate thickness of the liquid film. If the film is too thin, no droplets can separate, and if the film is too thick, no effective capillary waves are excited due to liquid damping.

High liquid throughputs of the atomiser and fine droplets can be achieved—independent of the liquid parameters—by means of bending wave atomisers. For example, an atomiser with bending wave resonator is known that has the shape of an elongated narrow strip, on which bending waves with several parallel nodal lines are generated by ultrasonic excitation (DE-OS No. 31 12 340). In the case of these devices, dimensionally stable, rigid titanium sheet strips of 1 to 2 mm thickness, 1 to 2 cm width and 20 cm to 2 m length are used. Excitation is effected by means of a piezoelectric stepped-horn concentrator, as a rule from the middle of the bending strip. The liquid to be atomised is supplied to the nodes of the transducer velocity amplitude through a perforated tube which is provided with outlet holes and positioned above or below the bending strip.

The essential drawback of this system results from the fact that in the case of bending wavelengths $\lambda_B$ exceeding the acoustic wavelength $\lambda_o$ in air, very intensive acoustic waves are radiated in air at an angle $\alpha$ made with the surface normal:

$$\cos \alpha = \lambda_o / \lambda_B$$

The high sound levels in this direction are highly disturbing and unnecessarily consume transducer energy. In addition, the inherent stability of the long bending wave resonator is not nearly sufficient to keep the resonator exactly parallel to the perforated liquid supply tube. If such long bending-wave resonators of a certain degree of dimensional stability were mechanically fixed, e.g. by so-called riders, the linearity of atomisation would be affected. Furthermore, fixing would have to be effected exactly at the velocity nodes, as otherwise resonant vibration would be disturbed. In principle, atomisation is not sufficiently homogeneous in the case of such relatively thick bending wave resonators, as atomisation takes only place between the parallel nodal lines and not in the regions of the nodes. Furthermore, the resonance frequencies in the spectrum of such a long bending resonator are still clearly separated. In the case of a titanium strip of 1 m length and 2 mm thickness, for example, the spacing of two adjacent resonances at 30 KHz is about 300 Hz. It is difficult to exactly maintain this resonance, but otherwise the positions of the nodes are shifted in an undesirable manner if changes occur, e.g. by temperature effects.

The object of the present invention is to develop a bending wave resonator which permits homogeneous and dense spray distribution with substantial saving of the power suppled by the generator.

According to the invention, this objective is reached by the fact that the bending strip has a comparatively small thickness such that it does not have sufficient inherent stability for linear alignment and that the dimensional stability of the bending strip is reached by at least one mechanical fixing device. Advantageous improvements of the invention are described in the subclaims.

According to the invention, a thin bending strip is used instead of the more massive bending strip with inherent stability. The thickness of the strip is preferably below 1 mm, in particular between 0.3 and 0.9 mm. For excitation, the strip is connected at one end with the stepped horn concentrator in a known manner, e.g. by a threaded joint. Dimensional stability, in particular linear alignment, is achieved by a mechanical fixing device at the other end of the bending strip which, according to a particularly preferred embodiment of the invention, serves to prestress the strip. Both the position of the fixing device and the degree of prestressing can be varied. Positioning of the fixing devices exactly at the ends of the resonator, i.e. outside the atomising zone of the atomiser permits uniform atomisation on practically the entire resonator length, with the exception of the two end sections.

The bending resonator can be oriented exactly parallel to the liquid supply tube, over a larger length than has been possible before. As the adjacent bending wave nodes are closer together, more uniform atomisation is possible. Exact orientation of the linearly and closely spaced liquid supply holes relative to the nodal lines, is no longer necessary. For this reason it is possible in principle to use a supply tube with longitudinal slit for liquid release, the gap between the slit and the bending strip being preferably provided with felt or the like.

At a small sheet thickness d of less than mm, the bending wavelength $\lambda_B$ is substantially smaller, as $\lambda_B$ is proportional to $\sqrt{d}$. As a result, the bending resonator does no longer transmit airborne sound with sharp directional characteristic into the environment which anyway does not contribute to atomisation. This permits, in addition, substantial reduction of the power required by the generator.

Because of the small frequency intervals between adjacent bending resonances (overtones) the long bending wave resonator (length l) is practically permanently in resonance, as the frequency interval f is proportional to the square root of sheet thickness d because of $f_n \sim (n/l)\sqrt{d}$. A variation between adjacent resonances, which does not affect the node positions at the end points of the resonator, can practically not be recognised by the generator; light sweeping of the excitation frequency practically causes the dense nodal positions to disappear. This, too, results in a substantially more uniform linear atomisation.

In the case of thin bending sheets of less than 0.5 mm thickness, which are made of highly resistive metals and alloys, e.g. high-temperature titanium or special alloys, such as special alloy spring steel, the bending sheet strip can be preheated by passage of electric current. It is thus possible to atomise viscous liquids, whose viscosity decreases substantially at elevated temperatures, in preheated state. Thus, it is also possible effectively to atomise low-melting-point metals.

The bending strips have not necessarily to be linearly stressed, but can also be bent into rings or into any other shapes that may be necessary for specific cases. In order to eliminate the static bending stress due to variation in shape, the strip can be thermally aged in the special shape or curvature required for the application concerned. Thus, it is possible, for example, to age high-temperature special alloy spring steel within two hours at 450° C. in a noble-gas atmosphere.

The invention is described in more detail on the basis of the following shematic drawings.

Figure 1:
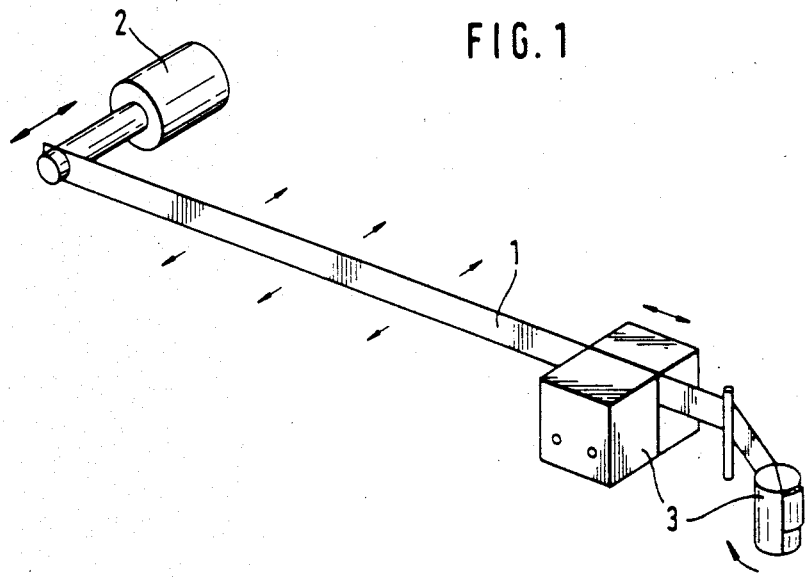
FIG. 1 shows one embodiment of the atomiser according to the invention.

In the embodiment according to FIG. 1, a narrow bending strip 1, which is so thin that it has no inherent stability in longitudinal direction, is connected at one end with the step horn concentrator 2 and at the other end with a prestressing device 3. The bending strip is passed through clamping jaws. The bending strip 1 can be excited by the axial vibration of the step horn concentrator 2. The bending strip is positioned normal to the axis of the excitation system 2. By shifting the end clamp on a prestressing frame with intermediate pieces, it is possible to vary the length of the atomiser within wide limits by simply exchanging the bending strip 1 against one of different length. The bending strip 1 can be made of strip material.

An 0.5-mm thick and 1-m long bending strip of a special titanium alloy with 90% Ti, 6% Al and 4% V was used to atomise liquids of viscosities below 10 m Pa·s on both sides of the strip. The atomiser permits atomisation of 200 to 300 l liquid per hour.

Figure 2:
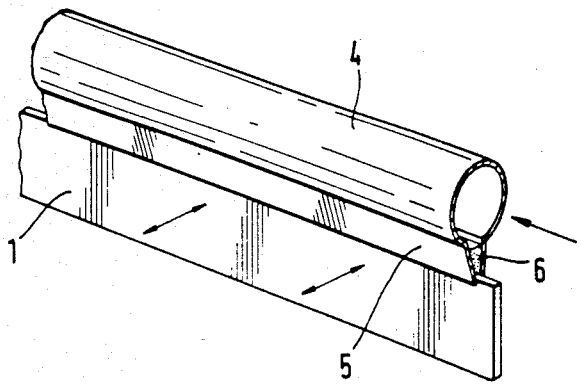
FIG. 2 shows one possible orientation of the liquid supply with respect to the linear bending wave resonator.

According to FIG. 2, liquid supply can be effected through a tube 4, which is oriented parallel to the bending strip 1.

Because of the nodal line density on the bending strip, the liquid can be supplied continuously and linearly through a slit 5. To achieve capillary supply, the slit 5 can be provided with an appropriate porous material 6, e.g. felt, fibres or the like.

Figure 3:
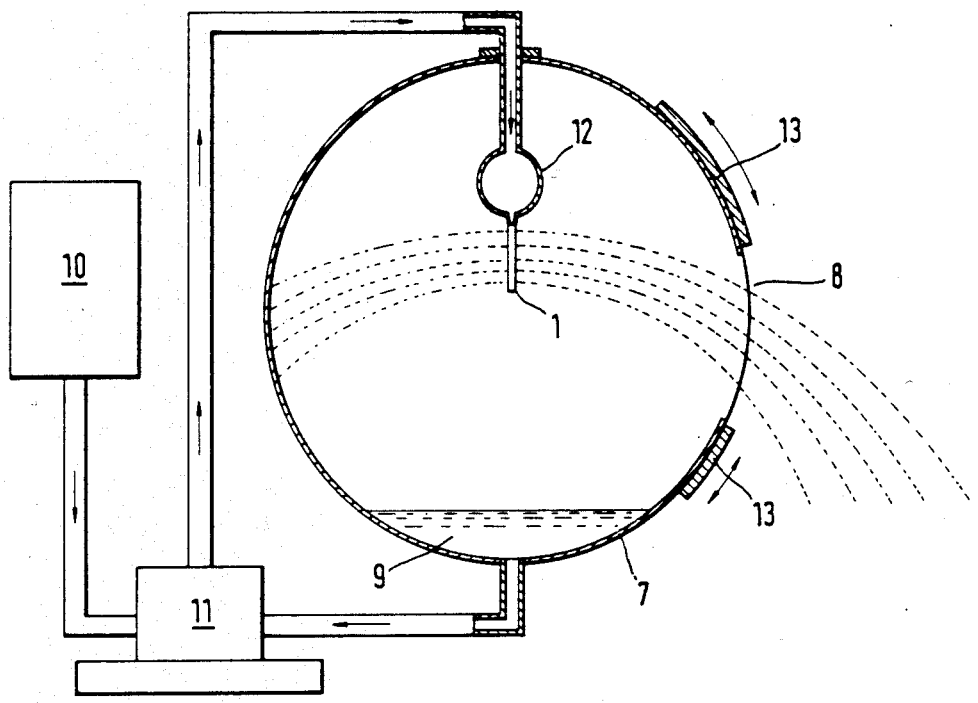
FIG. 3 shows the cross section of one embodiment for atomisation in an atomisation chamber.

It becomes obvious that liquids whose viscosity strongly increases during atomisation, due to evaporation of solvent components, can only with difficulty be atomised by means of bending wave atomisers. Gradually, a residue is formed on the bending wave resonator which may consist of suspended particles, adhesive constituents or crystallising components. This residue affects the vibrational behaviour of the bending wave resonator. It is proposed to prevent evaporation of solvent component by operating the atomiser according to FIG. 3 using a horizontal cylindrical chamber 7 with spray outlet slit 8. A solvent sump 9 on the bottom of the pipe 7, which can possible be heated, generates sufficient solvent vapour to ensure that a state of saturation adjusts around the atomiser. Evaporation then is effected only after atomisation, when the spray leaves the outlet slit 8 of the pipe 7.

In this embodiment, the liquid is fed from a container 10 through pump 11 to the liquid supply 12 and to the bending strip 1. By appropriate adjustment of the orifice plates 13, the spray outlet slit 8 of the pipe 7 can be adjusted such that only the finest droplets can escape through the slit 8.

We claim:

1. Liquid atomiser comprising a narrow linear bending strip (1) on which bending waves with several essentially parallel, closely spaced nodal lines can be generated, means to deliver a liquid to be atomised along the linear dimension of said narrow linear bending strip, excitation means (2) at one end of said narrow linear bending strip to impart an ultrasonic excitation thereto, and at least one mechanical fixing means (3) at the other end of said narrow linear bending strip to support said narrow bending strip, said narrow linear bending strip (1) having a comparatively small thickness such that it does not have sufficient inherent dimensional stability for linear alignment when in a horizontal plane said dimensional stability of the narrow bending strip being achieved by said at least one mechanical fixing means (3).

2. Liquid atomiser as claimed in claim 1, wherein the narrow linear bending strip consists of highly resistive metals or alloys and wherein the narrow linear bending strip has a thickness of less than 1 mm, preferably between 0.3 and 0.9 mm.

3. Liquid atomiser as claimed in claim 2 wherein the mechanical fixing means (3) is a prestressing device, by means of which any desired prestress of the narrow linear bending strip (1) can be provided.

4. Liquid atomiser as claimed in claim 2 wherein the position of the mechanical fixing device (3) on the narrow linear bending strip (1) can be varied.

5. Liquid atomiser as claimed in claim 2 wherein the narrow linear bending strip (1) can be interchanged.

6. Liquid Atomiser as claimed in claim 2 wherein said highly resistive metals or alloys are selected from the group consisting of titanium and stainless steel.

7. Liquid atomiser as claimed in claim 1, wherein the narrow linear bending strip (1) is mechanically prestressed in the longitudinal direction.

8. Liquid atomiser as claimed in claim 7, wherein the mechanical fixing means (3) is a prestressing device, by means of which any desired prestress of the narrow linear bending strip (1) can be provided.

9. Liquid atomiser as claimed in claim 8, wherein the position of the mechanical fixing device (3) on the narrow linear bending strip (1) can be varied.

10. Liquid atomiser as claimed in claim 9 wherein the narrow linear bending strip (1) in interchangeable.

11. Liquid atomiser as claimed in claim 7 wherein the position of the mechanical fixing device (3) on the narrow linear bending strip (1) can be varied.

12. Liquid atomiser as claimed in claim 7 wherein the narrow linear bending strip (1) can be interchanged.

13. Lqiquid atomiser as claimed in claim 8 wherein the narrow linear bending strip (1) can be interchanged.

14. Liquid atomiser as claimed in claim 1 wherein the mechanical fixing means (3) is a prestressing device, by measns of which any desired prestress of the narrow linear bending strip (1) can be provided.

15. Liquid atomiser as claimed in claim 1 wherein the position of the mechanical fixing device (3) on the narrow linear bending strip (1) can be varied.

16. Liquid atomiser as claimed in claim 1 wherein the narrow linear bending strip (1) can be interchanged.

17. Liquid atomiser as claimed in any one of claims 2, 7–10, 14, 3, 16, 15, 5, 11, 16 or 16, 12, 13 wherein the bending strip (1) is a positioned in a cylindrical chamber (7) of corresponding length and shape, said chamber being provided with a spray outlet slit (8) in the region of the atomising zone of the bending strip (1).

18. Liquid atomiser as claimed in claim 17, wherein the width of the spray outlet slit (8) can be varied.

* * * * *